US007062801B2

(12) United States Patent
Oliver

(10) Patent No.: US 7,062,801 B2
(45) Date of Patent: Jun. 20, 2006

(54) TWO-STAGED TOILED TANK BOWL CONTROL SYSTEM

(76) Inventor: John F. Oliver, Rd. 2, Box 96, Dagsboro, DE (US) 19939

( * ) Notice: Subject to any disclaimer, the term of this patent is extended or adjusted under 35 U.S.C. 154(b) by 113 days.

(21) Appl. No.: 10/880,246

(22) Filed: Jun. 29, 2004

(65) Prior Publication Data

US 2005/0283894 A1 Dec. 29, 2005

(51) Int. Cl.
*E03D 1/14* (2006.01)
*E03D 3/12* (2006.01)

(52) U.S. Cl. ..... 4/325; 4/407; 4/410

(58) Field of Classification Search ..... 4/324, 4/325, 405, 407, 410
See application file for complete search history.

(56) References Cited

U.S. PATENT DOCUMENTS 3,546,715 A * 12/1970 Wustner ..... 4/325
4,000,526 A * 1/1977 Biela et al. ..... 4/379
4,225,987 A * 10/1980 Goldman et al. ..... 4/325

* cited by examiner

*Primary Examiner*—Justine R. Yu
*Assistant Examiner*—Huyen Le
(74) *Attorney, Agent, or Firm*—Connolly Bove Lodge & Hutz

(57) ABSTRACT

A two stage toilet tank bowl control system includes a tank ball selectively positioned on the valve seat in the water tank. The tank ball is linked to a lifting lever so as to raise the tank ball from the seat when the lifting lever is rotated in its flushing direction. An air outlet tube communicates with the interior of the tank ball to permit air to be exhausted from the interior of the tank ball. The air tube communicates with a passageway in a air flow block mounted to the wall of the water tank. The passageway has a full flush branch and a partial flush branch. A partial flush valve maintains the partial flush branch closed during conditions of full flush. A full flush handle moves the lifting lever in its flushing direction with the partial flush valve maintained in a closing condition against the outlet of the partial flush branch. A partial flush handle moves the lifting lever in its flushing direction in such a manner as to remove the partial flush valve from the partial flush branch outlet so that air is purged at a greater flow rate from the tank ball under partial flush conditions than under full flush conditions to return the tank ball to its closing position on the valve seat in a shorter period of time than under full flush conditions.

26 Claims, 10 Drawing Sheets

10
12
13
14
16
20
22
24
26
28
30
34
36
38
40
42
44
50
52
64
66
68
86
88
90
92
94
98
100

Fig. 4.
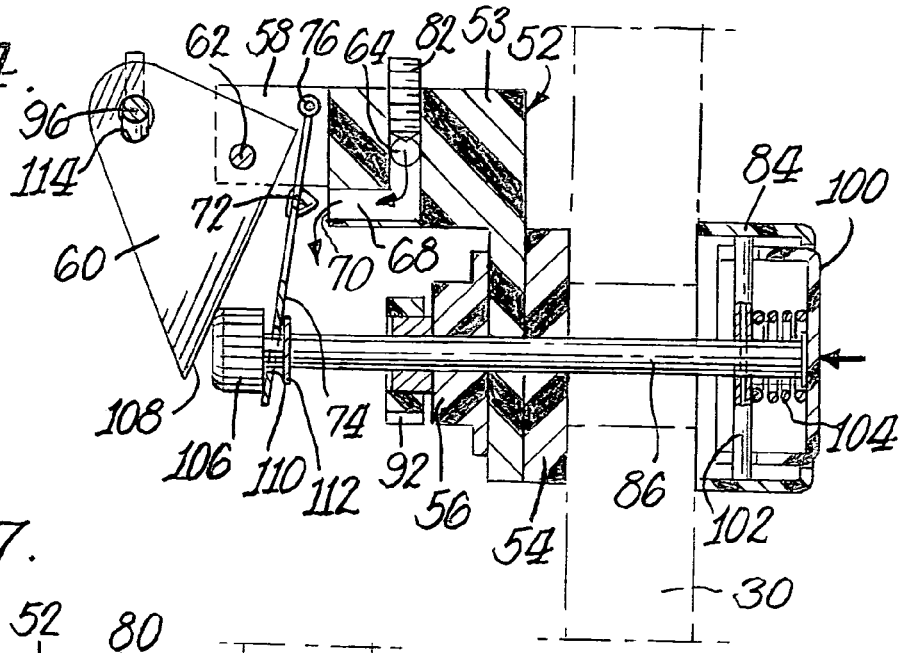
Fig. 7.
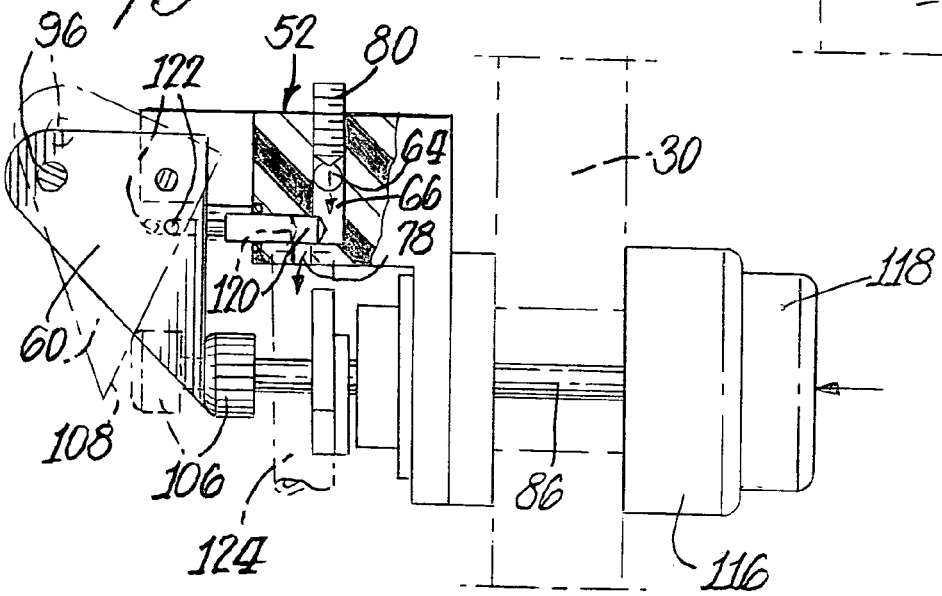
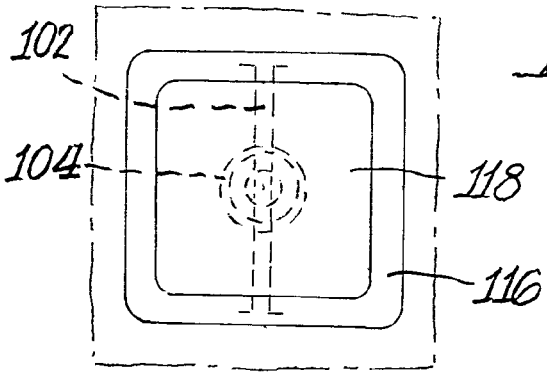
Fig. 8.

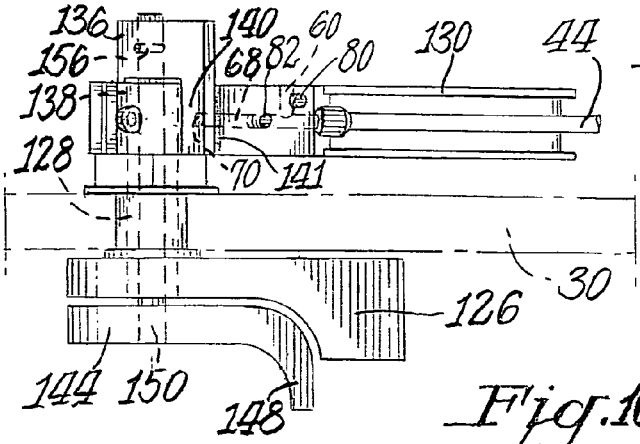
Fig. 12.
Fig. 10
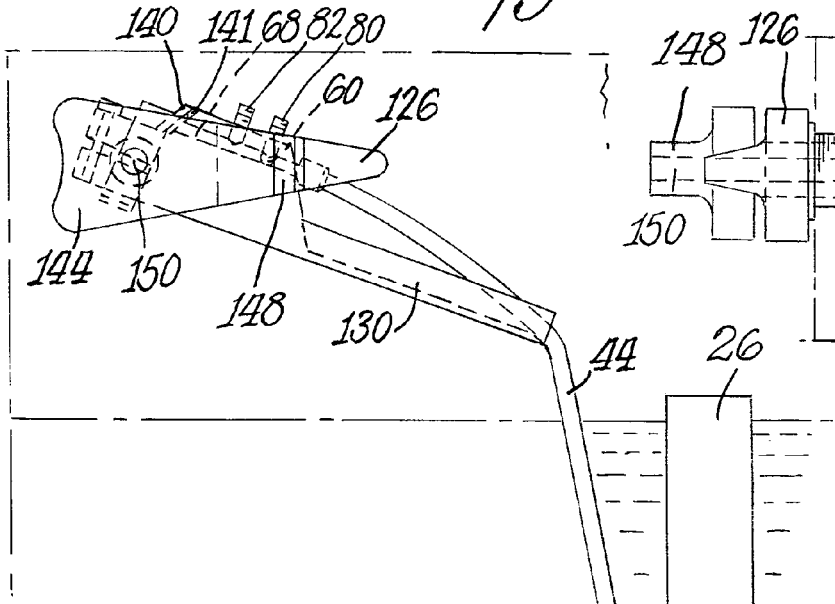
Fig. 11.
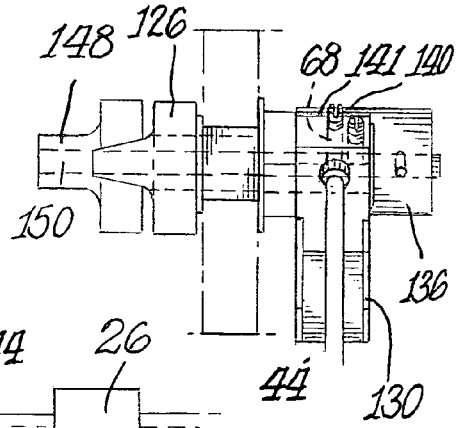
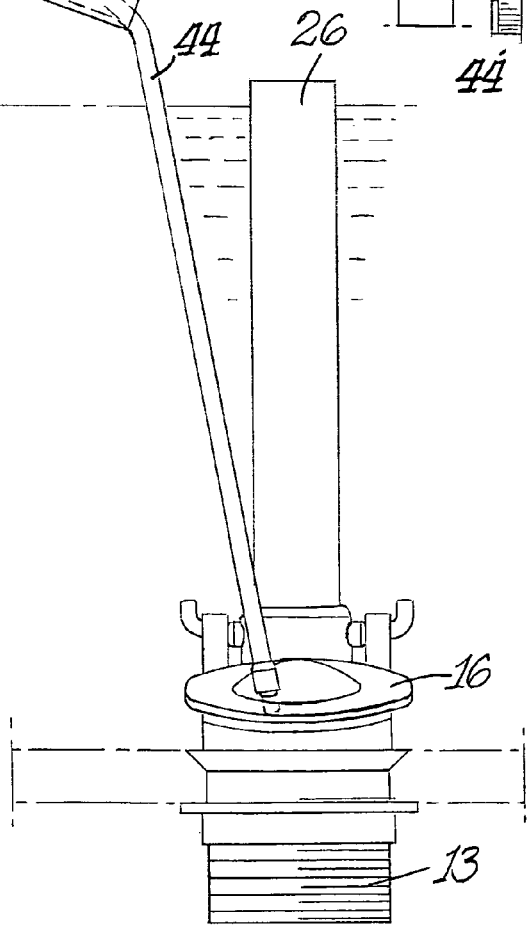

TWO-STAGED TOILED TANK BOWL CONTROL SYSTEM

BACKGROUND OF THE INVENTION

There is a growing consciousness of the need to conserve water, particularly in toilets where it is not always necessary to have a full flushing of the toilet. In order to conserve flushing water, attempts have been made at providing two step flushing control type systems wherein there are two flushing modes. One of the modes is a full discharge flushing and the other is a water saving or partial flushing mode.

Typical toilets include a flush handle mounted on the outside of the tank. When the handle is manually pressed a valve, such as a flapper valve, is lifted from the valve seat. The flapper valve includes an inverted air chamber so that it initially floats as it is lifted away from the valve seat or drain outlet. This floating flapper valve permits water to flow into the bowl even if the user immediately releases the flush handle. As the body of water flows through the drain outlet of the tank it starts the syphoning action in the bowl and flushes the standing water in the bowl along with its waste contents into the sewer line. When the tank is nearly empty the flapper valve closes and the tank continues to fill as the float ball connected to the ball cock rises. At the same time water from the ball cock valve enters an overflow tube to refill the bowl to its normal water level and the bowl cock valve closes.

Because of water shortages, particularly those which periodically result in significant portions of the United States, there have been major conservation efforts including efforts directed to conventional toilets which are wasteful and inefficient since a relatively large quantity of water is used to accomplish every flush.

Patents directed toward dual flush operations are U.S. Pat. Nos. 6,704,945, 5,943,708 and 5,375,268.

SUMMARY OF THE INVENTION

An object of this invention is to provide a two-stage toilet tank bowl control system which permits a full flush and when desired a partial flush.

A further object of this invention is to provide such a control system wherein the selection of a full flush or a partial flush can be readily accomplished by the user.

In accordance with a preferred practice of this invention the two-stage toilet tank bowl control system includes a tank ball, such as a flapper valve, which is on the valve seat or drain outlet in the tank. An actuating system is mounted to a wall of the tank and includes a lifting member, such as a lever, connected to the tank ball by a transmission member, such as a chain, in a conventional manner so that the tank ball is removed from the seat when the lifting member is raised or moved in a flushing direction and the tank ball returns to the valve seat when the lifting member is moved in its downward or return direction. An air tube is mounted at one end to the hollow housing which forms the tank ball. The other end of the air tube is in flow communication with a passageway in an air flow block mounted to the tank wall as part of the actuating system. The passageway has a full flush branch with an outlet end and a partial flush branch with an outlet end, each of which leads to the outer surface of the block. A partial flush valve selectively opens and closes the outlet end of the partial flush branch. The actuating system also includes a handle assembly having a full flush or master handle structure which moves the tank ball off the valve seat so that air may flow from the ball housing through the passageway and the full flush branch and then out of the block while the partial flush valve continues to close air flow from the partial flush branch. The handle assembly also includes a partial flush or auxiliary handle structure which moves the tank ball off the valve seat to permit air to flow from the hollow housing of the tank ball through the passageway and through the partial flush branch and then out of the partial flush branch with the partial flush valve being moved to its open position. As a result air is more quickly purged from the tank ball and the tank ball returns more quickly to the valve seat. As a result, a lesser amount of water is used with the partial flush than with the full flush.

In a preferred practice of this invention the full flush handle structure may be a pivoted lever type master handle while the partial flush structure may be an inwardly moving push button auxiliary handle. The full flush lever handle is mounted to a shaft which extends through and is connected to a link which in turn is connected to an extension of the lifting lever. As a result, when the full flush handle is rotated, the shaft is also rotated to rotate the link and thereby also rotate the lifting lever in its flushing direction so that the tank ball is removed from the valve seat. The partial flush handle or button is also connected to the shaft and can be moved inwardly. The shaft terminates in a pushing member abutting against a pivoted actuator. The lifting lever is inserted through a hole in the actuator so that rotation of the actuator causes the lifting lever to rotate in an upward direction for unseating the tank ball. A carrier, such as a leaf spring or plate on the shaft is pivotally mounted to the block and carries the partial flow valve. When the shaft is moved inwardly by pushing the partial flow push button handle the carrier is also moved inwardly to withdraw the valve from closing the outlet of the partial flow branch of the passageway so that air can flow through the passageway and exit from the bypass branch more quickly than the air would exit where only the full flow branch is used thereby closing the tank ball more quickly than when actuated by the full flush or master handle.

Various other alternatives are described for opening and closing the partial flow branch of the passageway and for forming the full flush and partial flush handle structure.

THE DRAWINGS

FIG. 4 is a fragmental cross-sectional view in elevation taken through FIG. 3 along the line 4—4;

FIG. 7 is a fragmental cross-sectional view in elevation showing a further embodiment of this invention;

FIG. 8 is a fragmental front elevational view of the embodiment shown in FIG. 7;

FIG. 10 is a side elevational view of the system shown in the system of FIG. 9;

FIG. 11 is a right side elevational view of the system shown in FIGS. 9–10;

FIG. 12 is a top plan view of the system shown in FIGS. 9–11;

DETAILED DESCRIPTION

Figure 1:
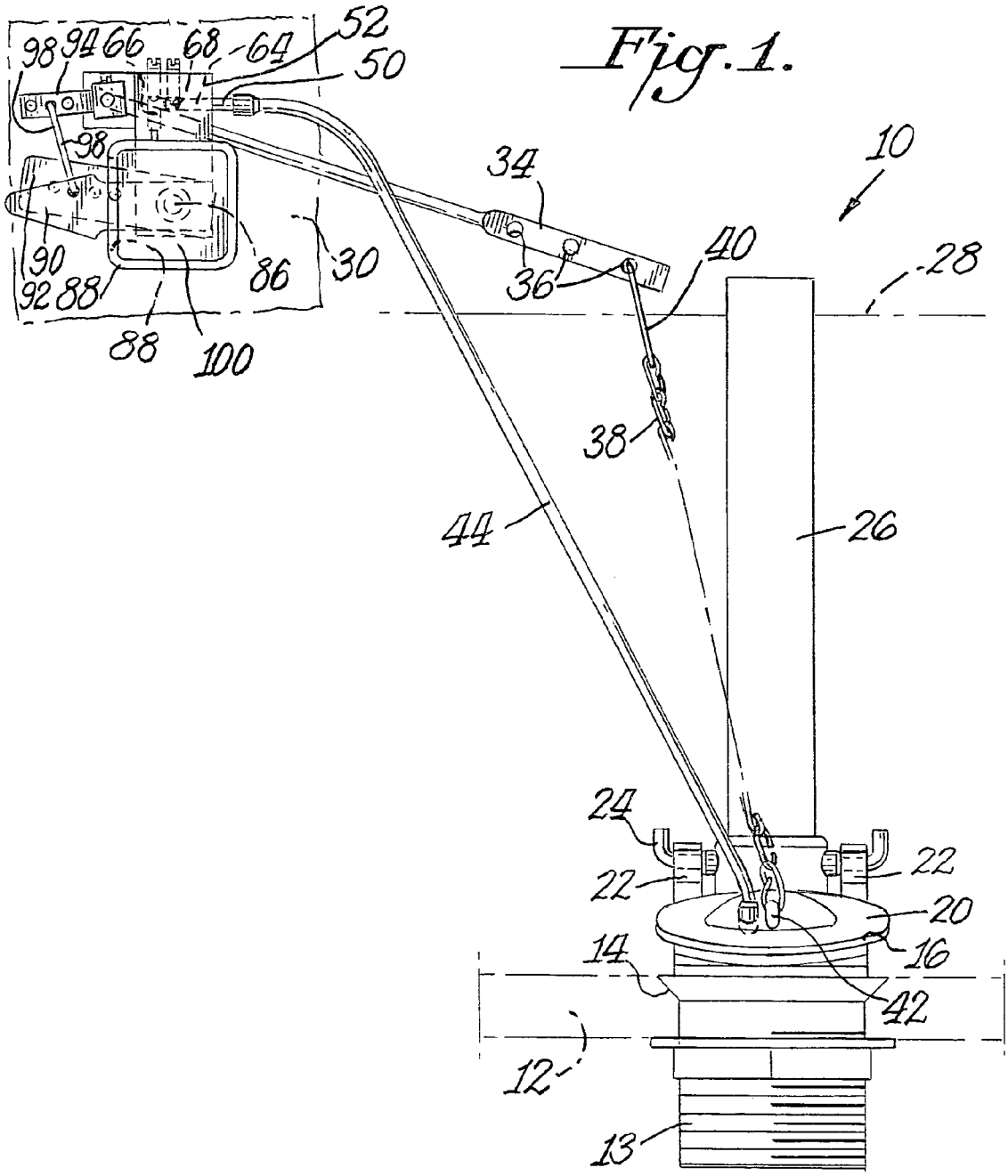
FIG. 1 is a fragmental elevational view of a two-stage toilet tank bowl control system in accordance with this invention.
Figure 5:
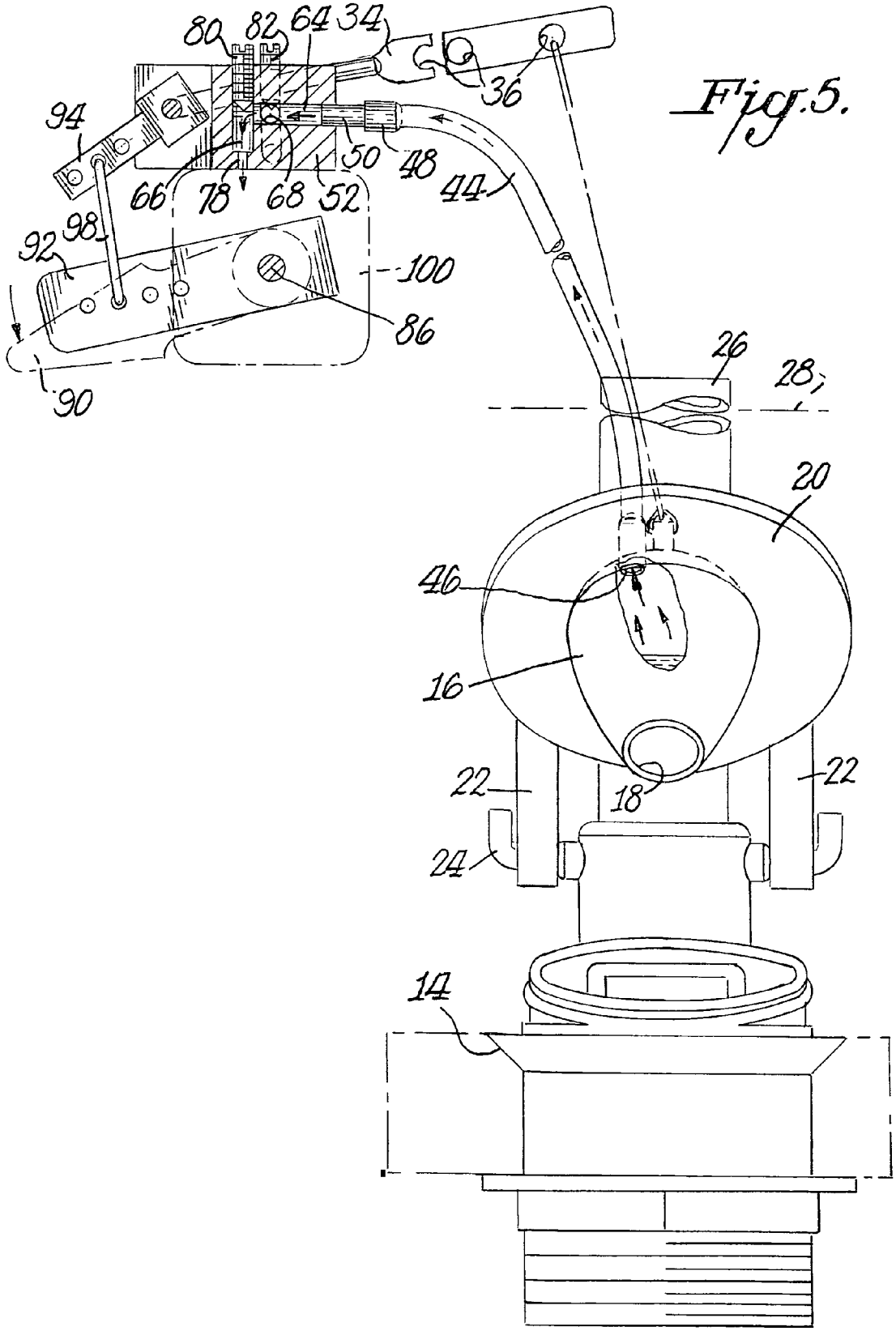
FIG. 5 is a view similar to FIG. 1 showing the system in a further phase of operation.

FIGS. 1–5 show one embodiment of this invention relating to a two-stage toilet tank bowl control system 10. As shown therein system 10 would be used in conjunction with a conventional water tank 12 of a toilet. Within the water tank is a drain 13 having a valve seat 14 which is selectively opened and closed by a tank ball 16 which could be of flapper valve type construction. Generally, as shown in FIG. 5, ball 16 is in the form of a hollow housing having an open end 18 which is inserted into the drain until the outwardly tapered arcuate sides of the housing seat against and close the drain. A circular rim 20 is located outwardly of the housing in the upper area of the housing. A pair of arms 22 are provided on each side of the ball 16 hinged to extensions 24 of overflow tube 26 in a known manner. When the ball 16 is lifted away from seat 14 as shown, for example, in FIG. 5 the drain is exposed and water flows downwardly through the drain past seat 14. When the ball is in its closed position shown in FIG. 1 water can not escape through the drain. FIGS. 1 and 5 illustrate the water level by the reference numeral 28.

System 10 includes an actuating system for controlling the flushing operation. The actuating system is suitably mounted to a wall of tank 12 such as to the front wall 30 as illustrated in FIGS. 1–5.

The actuating system includes a lifting member such as a lever 34 of known construction. Lever 34 would have a suitable number of holes 36 to provide a site of connection to the tank ball 16. The connection is made by a transmission member which could be a chain 38 having a hook 40 at its upper end which is inserted into one of the holes 36. The lower end of chain 38 would be secured to an attachment member 42 on the tank ball 16. When lifting lever 34 is rotated in an upward or flushing direction such as shown in FIG. 5 the tank ball 16 is pivoted upwardly out of closing contact with seat 14. When lever 34 is permitted to move in its return direction to the position shown in FIG. 1 tank ball 16 is permitted to pivot back into closing contact with seat 16.

Figure 2:
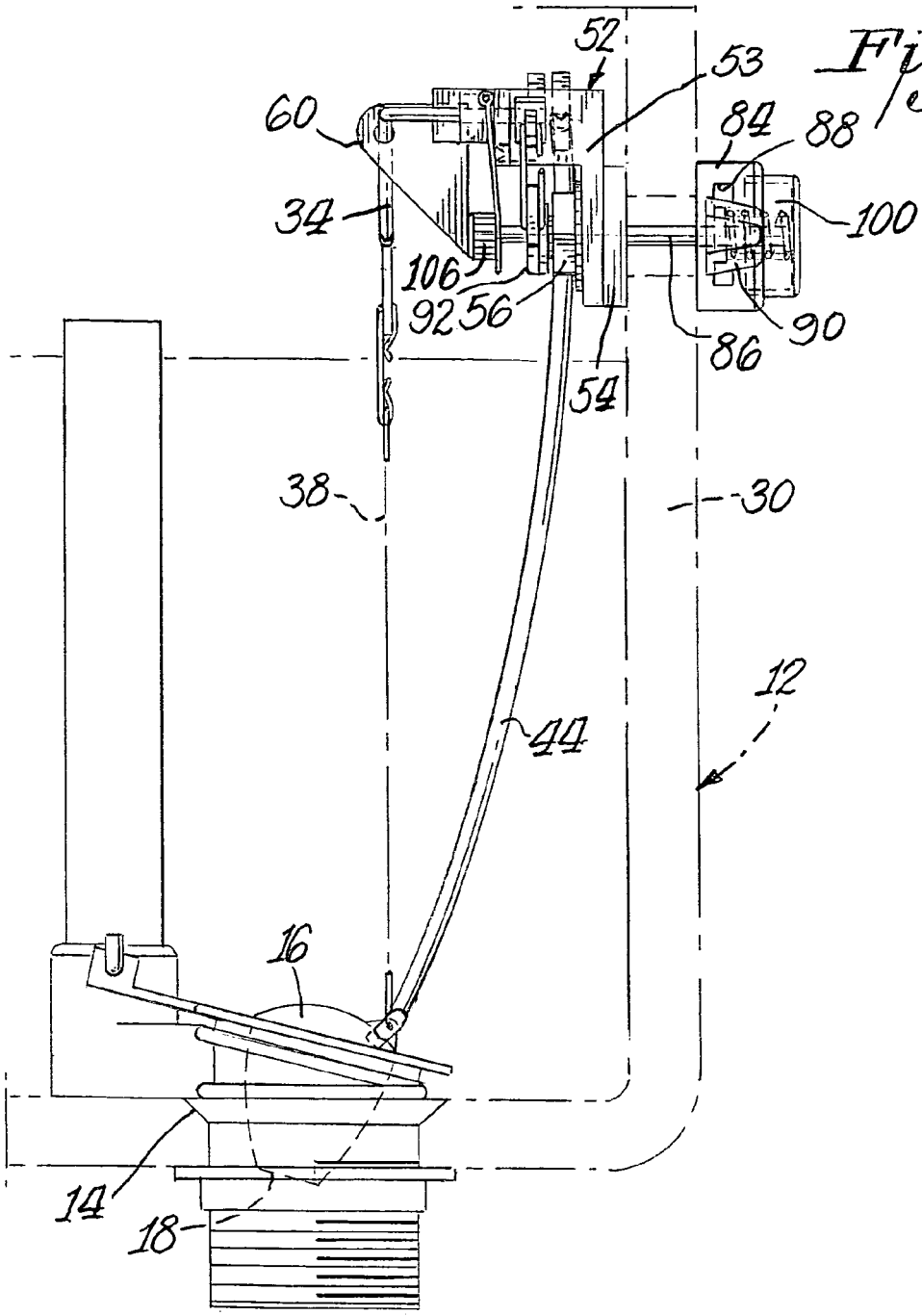
FIG. 2 is a left side elevational view of the system shown in FIG. 1.

In accordance with this invention an air tube 44 is mounted to the top of tank ball 16 and communicates with the hollow interior or chamber of the tank ball as shown by the reference number 46 in FIG. 5. The opposite end 48 of tube 44 fits on nipple 50 mounted to and extending from an air flow block 52 mounted to wall 30 of tank 12. Air flow block 52 includes a number of components which could be integral with or separate from and then disposed against the main body portion. For example, as illustrated in FIGS. 2 and 4 the main body portion 53 of block 52 is of inverted L-shape and could be made of any suitable material such as Delrin or other plastic. A spacer plate 54 is mounted directly against wall 30 and is secured to L-shaped member 53. A further plate 56, which could be a threaded nut, is mounted against the downward extension of member 53 as best shown in FIG. 4.

Figure 3:
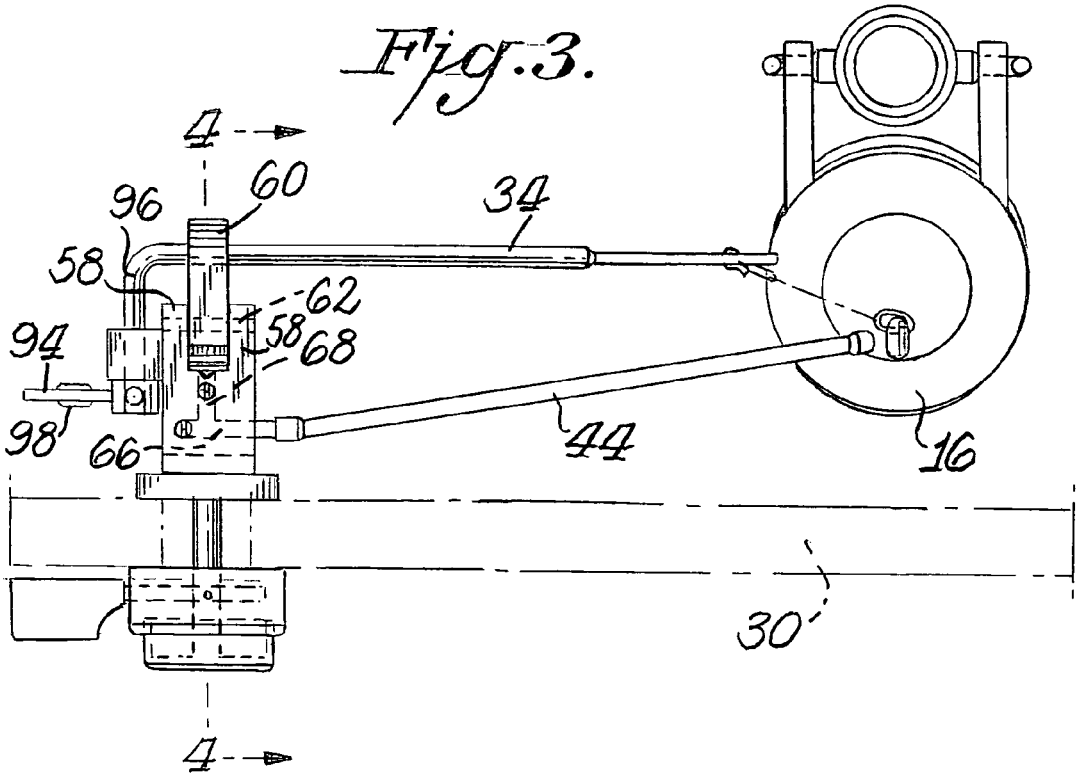
FIG. 3 is a top plan view of the system shown in FIGS. 1–2.

As shown in FIGS. 3 and 4 the upper portion of member 53 is slotted to provide a pair of extensions 58,58. A generally triangularly shape actuator 60 is pivotally mounted to these extensions by being inserted into the slot with a pivot pin 62 spanning the extensions 58,58 and extending through a hole in actuator 60 for purposes which will later be described.

As shown in FIG. 1 nipple 50 communicates with a flow passageway 64 so that air flowing from the interior of the hollow tank ball 16 can flow through tube 44 and into passageway 64. Passageway 64 communicates with two branch passages. One branch passage 66 may be considered a full flush branch and is shown in FIG. 1 to extend vertically downwardly from passage 64 to the exposed surface of block 52. See also FIG. 5. The second branch passage 68 is best shown in FIG. 4. As shown therein, branch passage 68 communicates with main passageway 64 and then leads to the outer surface of block 52 having its outlet end 70 on a vertical wall of the block. The outlet 70 serves as a seat which is opened and closed by a partial flush valve 72 mounted on resilient plate or spring member 74. Valve 72 may be of any suitable construction. In the illustrated embodiment valve 72 is a resilient plug with a tapered, conical or circular outer surface. As illustrated in FIG. 4 a carrier such as a leaf spring plate 74 is pivoted at one end 76 to block member 53 in the slot formed between extensions 58,58 as will be later described.

Flow from the air tube 44 into passageway 64 may then exit from air flow block 52 through full flush branch 66 and/or through partial flush branch 68. The outlet end 78 of full flush branch 66 is preferably always open. The branch, however, may be completely or partially closed and be of restricted flow capacity by manipulating a suitable valve, such as needle valve 80 as shown in FIG. 5. Similarly, flow into and through partial flush branch 68 may be restricted or closed by manipulating a valve, such as needle valve 82 as shown in FIG. 4. Flow control members, such as needle valves 80,82, thus provide the ability to achieve fine tuned adjustment through branch 66,68 or any other flow passageways which could incorporate such flow control members.

The invention is based upon the recognition that when a tank ball is used, such as illustrated, air inside the ball tends to make the ball more buoyant which delays the ball returning to its valve seat closing position thereby prolonging the flush. If air is expunged from the ball, the air is displaced by water causing the ball to be less buoyant and resulting in a faster valve seating with a shorter flush. The use of air outlet tube 44 to permit the air to be quickly expunged by opening the outlet 70 of the partial flush branch 68 or to take longer to be expunged through only the full flush branch 66. This provides the user with the option of a full flush (such as for solid waste) or a partial flush (such as for liquid waste). With conventional toilets there might be eight flush cycles in a day, for one solid waste flush and seven liquid waste flushes. This could result in the use of about 12.8 gallons of water for the eight full flushes. The ability to have seven partial flushes, as with the invention, could result in a water use reduction of 5.4 gallons per day.

The present invention includes the use of a handle assembly to control the flow of air being exhausted from the system. In the embodiment of FIGS. 1–5, the handle assembly includes master handle structure and auxiliary handle structure. This structure includes a hollow casing 84 secured to wall 30. A shaft 86 extends through wall 30 and through air flow block 52. On the other side of wall 30 shaft 86 extends into casing 84. Casing 84 includes an elongated slot 88 through which a lever type master handle 90 extends with the shaft 86 extending through a opening in master handle 90. Master handle 90 is operatively secured to shaft 86 in any suitable manner whereby the pivoting or rotation of handle 90 causes the shaft 86 to also rotate. The mounting is such however, that shaft 86 can move transversely through the opening in handle 90 without causing transverse movement of handle 90. For example, shaft 86 could include a longitudinal groove into which a pin from handle 90 extends. Thus when handle 90 is rotated, the pin would cause the shaft to rotate. If shaft 86 is moved horizontally, the pin would simply slide in the shaft slot without resulting in any movement of the handle 90.

As shown in FIGS. 1 and 5, a lifting link 92 is fixedly mounted to shaft 86. The lifting lever 34 is of generally L-shape as shown in FIG. 3 and extends through a hole in actuator 60 with its bent end 96 being mounted to an extension 94 directly above lifting link 92. A rigid connecting member 98 is pivotally mounted in selective holes in lifting link 92 and lever extension 94 as best shown in FIG. 1 and FIG. 5. Lifting link 92 and lever extension 94 are preferably coplanar in a vertical plane perpendicular to shaft 86. The bent end 96 of lifting lever 34 is parallel to shaft 86.

In operation, when master handle 90 is rotated downwardly, shaft 86 is also rotated downwardly causing lifting link 92 to rotate downwardly as shown by the arrow in FIG. 5. The downward rotation of lifting link 92 causes lever extension 94 to also rotate downwardly which in turn however causes the lifting lever 34 to rotate upwardly as shown in FIG. 5 so that the tank ball 16 is raised away from seat 14 permitting water to drain and forcing air through tube 44 as previously described and as shown by the arrows.

As shown in FIGS. 2 and 4, shaft 86 extends through an opening in carrier 74. When shaft 86 merely rotates as during the flushing by using master handle 90, the carrier 74 remains stationary abutting against pusher 106 at the end of shaft 86. Valve 72 carried by carrier 74 remains in its closing position against outlet 70 of partial flush branch 68 in the conditions shown in FIG. 2. Accordingly, the air flow from tube 44 exits solely through full flush branch 66 and there is a full flushing of the toilet which would be desired particularly when solid waste is being flushed.

The system 10 also includes auxiliary handle structure which is illustrated as comprising a push button 100 slidably mounted in the open end of casing 84 as best shown in FIG. 4. Push button 100 is mounted against the outer end of shaft 86. Shaft 86 includes stop pins 102. A spring 104 is mounted against push button 100 and stop pins 102 to urge push button 100 in its outwardly extended or non-use condition which is shown in FIG. 2 in a direction opposite the arrows shown in FIG. 4. When push button 100 is pressed inwardly, as shown in FIG. 4, the shaft 86 is forced inwardly sliding through the opening in master handle 90. The opposite end of shaft 86 carries a pusher member 106 disposed against a wall 108 of actuator 60. Shaft 86 fits snugly in hole 110 of carrier or spring plate 74. Shaft 86 also carries a stop or abutment member 112 as shown in FIG. 4. In the condition shown in FIG. 2 abutment 112 is located in a recess in link 94. Abutment 112 limits the outward movement of shaft 86. During the inward movement the snug fitting of shaft 86 in hole 112 of spring plate 74 causes the spring plate 74 to pivot about its pivot pin 76 carrying valve 72 with it, to open the outlet 70 of partial flush branch 68, as shown in FIG. 4. As further assurance, if the movement of shaft 86 is not sufficient to pivot spring plate 74, abutment 112 will contact spring plate 74 to assure the movement of valve 72 to its open position. Conversely, abutment 112 prevents plate 74 from returning to a valve closing position by preventing the spring plate from sliding backwards on shaft 86 toward link 92. When in this open position shown in FIG. 4, the air being exhausted from the hollow housing of tank ball 16 is exhausted more quickly than under the full flush condition because both branches 66 and 68 are open. This causes the tank ball to close more quickly than under full flush conditions thereby using less water for flushing such as when only liquid waste is being flushed. As a result there is a conservation in the use of water.

While the embodiment of FIGS. 1–5 have been described in connection with open and closed flow from, for example, either of the branches 66 and 68. The open flow and the closed flow need not be a completely open or a completely closed flow but could be restricted flow such as by the manipulation of the needle valves 80 and 82.

The two-stage toilet tank bowl control system thus offers the user the option of actuating the master handle 90 when full flush operation is desired or actuating the auxiliary handle 100 when partial flush operation is desired. Under conditions of partial flush operation, the system includes provisions for increasing the exhaustion of air from the tank ball 16 so that the tank ball 16 more quickly returns against the seat 14 to close off further flow of water through the drain 13 of the tank 12. FIGS. 1–5 illustrate a preferred practice of the invention, other variations however could also be used as will be described with respect to other embodiments.

When push button or auxiliary handle 100 is pressed inwardly as shown by the arrow in FIG. 4, shaft 86 is also moved inwardly forcing pusher 106 against side 108 of actuator 60. As a result, actuator 60 pivots about pivot pin 62. Because lifting lever 34 extends through actuator hole 114, when actuator 60 is rotated upwardly or in a clockwise direction as shown in FIG. 4, from the position originally shown in FIG. 2, the engagement of the lever with the edges of hole 114 results in the lifting lever 34 being moved upwardly or in a counter-clockwise or flushing direction to lift tank ball 16 off seat 14.

Figure 6:
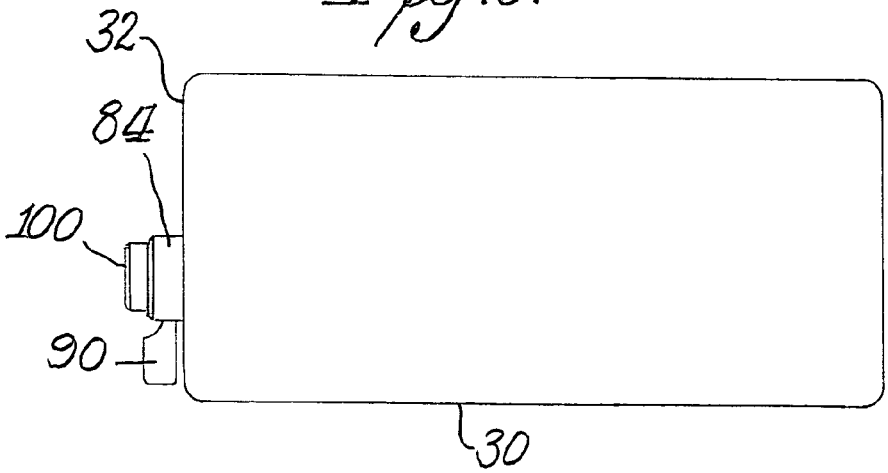
FIG. 6 is a top plan view showing the general shape of a tank with a system similar to that of FIGS. 1–5 mounted on a different wall of the tank.

For the sake of illustration, FIGS. 1–5 show the system 10 to be mounted to a front wall 30 of tank 12. The invention however could be practiced where the system is mounted to any other wall such as to a side wall 32 as shown in FIG. 6.

FIGS. 7–8 show a further embodiment of this invention with regard to structure for effecting a full flush. As shown therein, the handle structure includes a casing 116 mounted to the wall 30 with a push button 118 slidably mounted in casing 116, push button 118 is similar to push button 100. In this embodiment, the system would include the shaft 86 having a pusher 106 at its remote end disposed against the wall 108 of actuator 60, which is pivotably secured to air flow block 52. A difference in this arrangement, however, is that the opening and closing of the full flow branch 66 is controlled by a piston 120 pivotably mounted at one end 122 to actuator 60 and slidably mounted in a passage communicating with branch 66 upstream from branch outlet 78. In the position shown in solid piston 120 closes off outlet 78 to prevent air from leaving branch 66 through outlet 78.

When push button 118 is moved inwardly in the direction of the arrow shown in FIG. 7, the shaft 86 is moved toward the left causing pusher 106 to rotate actuator 60 from the position shown in solid to the position shown in phantom. When actuator 60 is rotated in this clockwise direction, piston 120 is pulled from the position shown in solid which closes the outlet 78 from the main portion of branch 66 to the open position shown in phantom whereby the air flowing through the passageway 64 and into branch 66 may be discharged through outlet 78.

Figure 17:
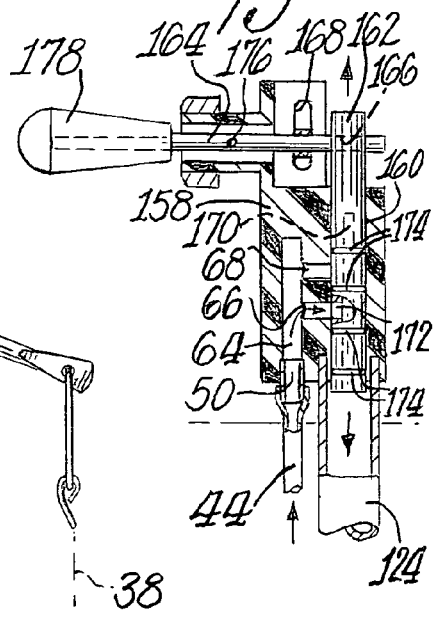
FIG. 17 is a cross-sectional view taken through FIG. 15 along the line 17—17.
Figure 18:
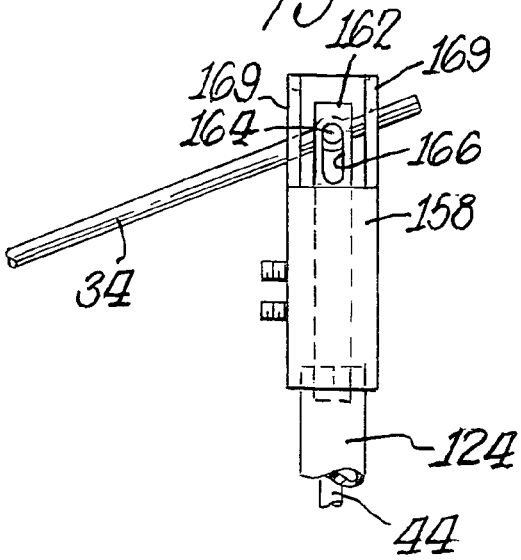
FIGS. 18–19 are rear and side elevational views of the system shown in FIGS. 15–17.

If desired, a power assist evacuation tube 124 (shown in phantom) could be mounted to the support or air flow block 52 at outlet 78 to assist in purging the air from the tank ball. In that regard, power assist evacuation tube would be of sufficient length to extend below the water level so that some water is in power assist tube 124. When the flushing operation takes place, the water flows outwardly from power assist tube 124 into the tank thereby creating a suction above the lowering level of water in tube 124. (This is also shown in FIG. 17.) The suction created in tube 124 assists in pulling the air through the system from the tank ball and the air tube and the various passageways. Although not illustrated, a power assist tube may also be mounted to outlet 78 in the embodiment of FIGS. 1–5.

When push button 118 is pushed inwardly, shaft 86 also moves inwardly and pusher 106 causes actuator 60 to pivot from the position shown in solid to the position shown in phantom. This rotation of actuator 60 causes bent end 96 of the lifter lever to rotate thereby lifting the ball 16 from seat 14, as previously described. The rotation of actuator 60 also causes piston 120 to be retracted and opens outlet 78 of branch 66.

The flow rate of the air being discharged through outlet of branch 66 can be adjusted by manipulation of a valve such as needle valve 80. In addition, the flow rate can be adjusted by controlling the throw or reciprocating movement of the piston 120. These adjustments of flow rate will determine the amount of flush thus rendering the system capable of being a full flush with restricted flow rate and slow air evacuation or being a partial flush with a higher rate of air evacuation.

The push button type handle structure used as the master handle, shown in FIG. 7 could be used where the system incorporates solely a full flush system. Alternatively, the master handle structure could be used in conjunction with an auxiliary handle to effect a partial flow, for example, the full flush could result when push button 118 is pushed inwardly to a first position as described with regard to FIG. 7. Continued pushing could result in the opening of the partial flush branch similar to what was described with regard to FIGS. 1–5 wherein a spring plate could be mounted on shaft 86 to open the outlet of a partial flush branch when shaft 86 has been pushed further inwardly by a continued pushing of the push button 118.

Figure 9:
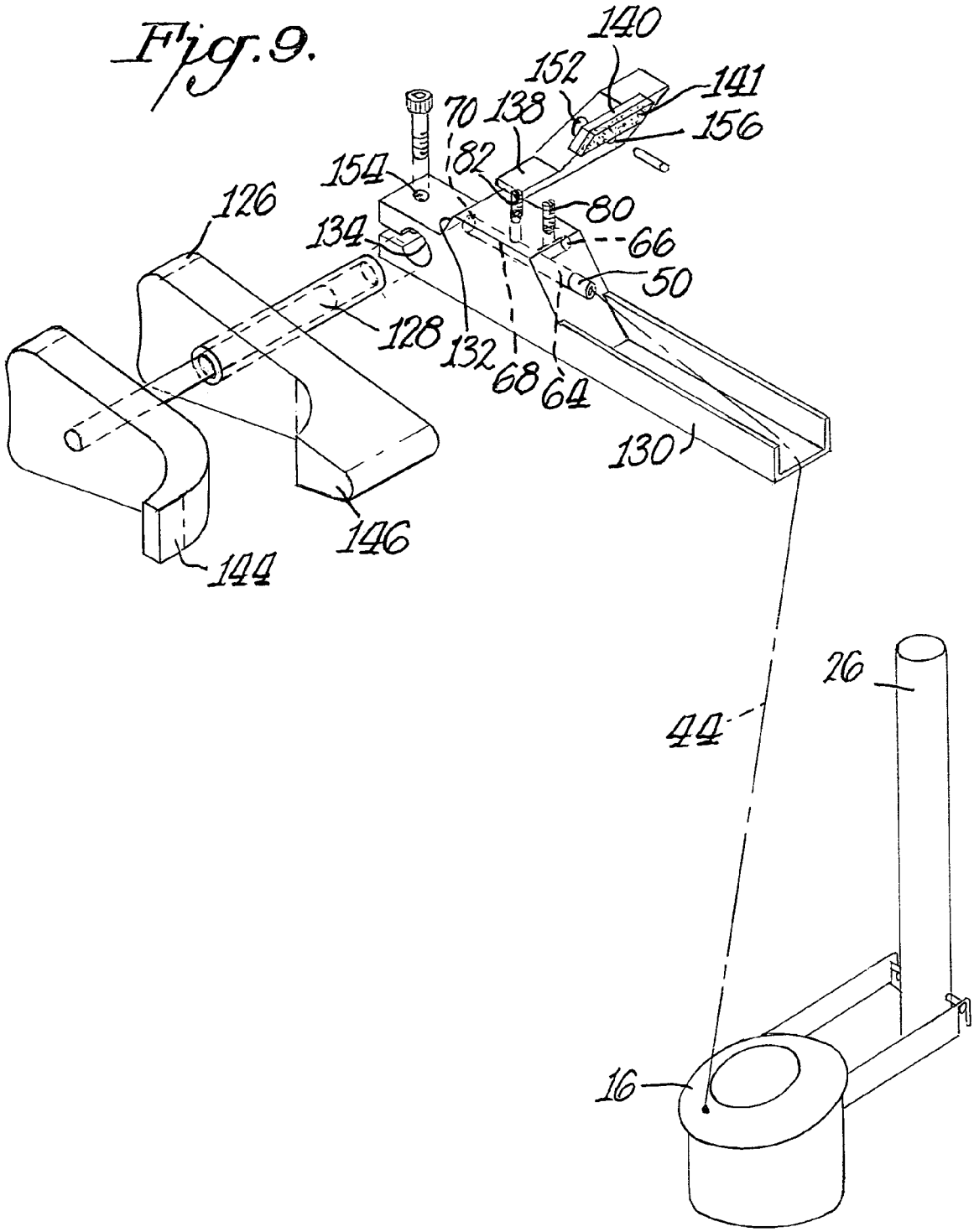
FIG. 9 is an exploded view of a further embodiment of this invention.
Figure 13:
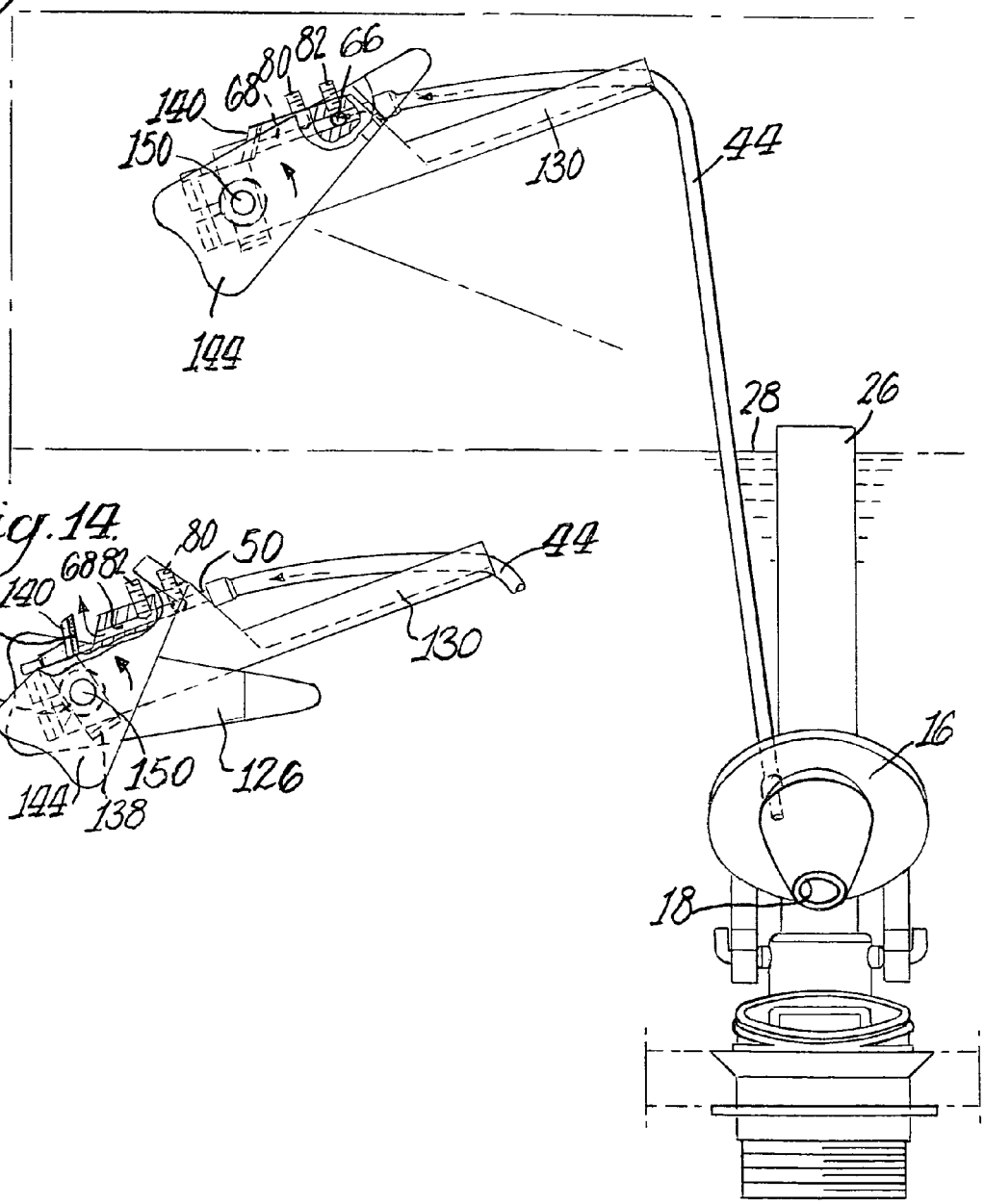
FIG. 13 is a side elevational view similar to FIG. 10 in a different phase of operation.
Figure 14:
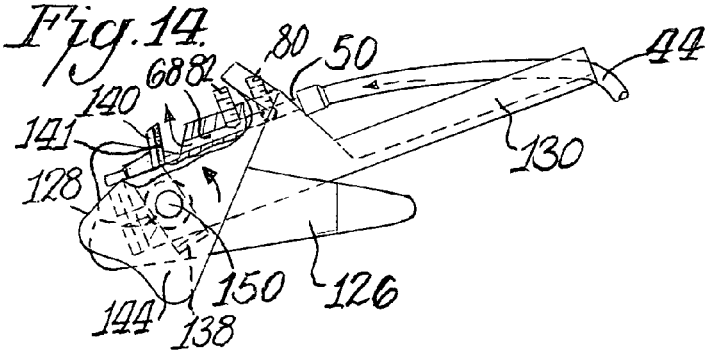
FIG. 14 is a side elevational view of the handle structure shown in FIG. 10 in a different phase of operation.
Figure 16:
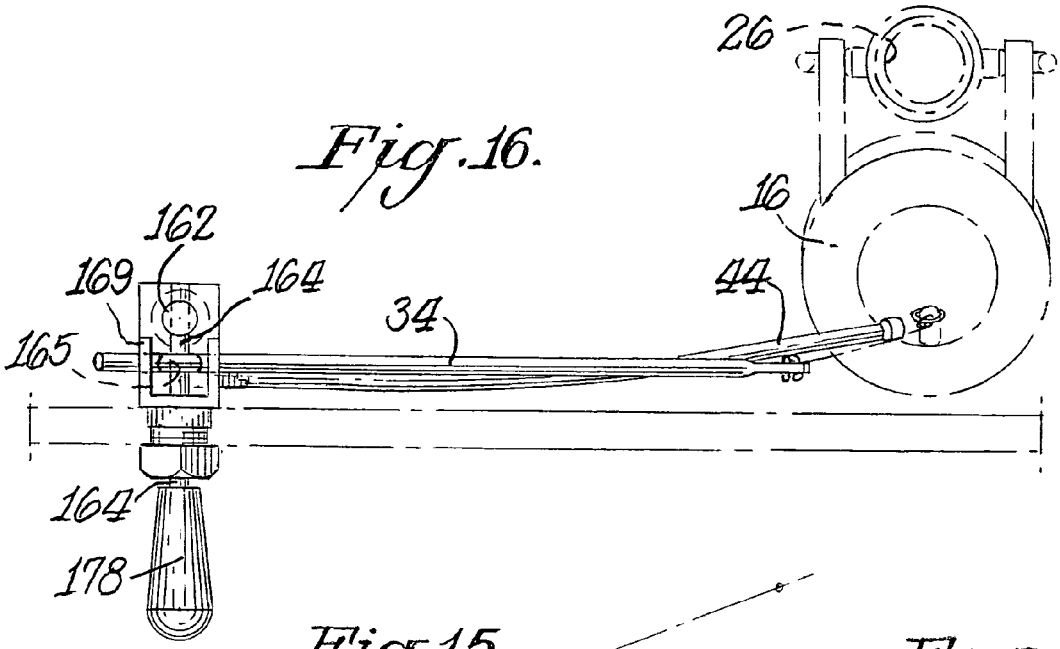
FIG. 16 is a top plan view of the system shown in FIG. 15.

FIGS. 9–14 show a further embodiment of this invention for providing the user with a two-stage control system. FIG. 9 shows various components of this system before assembly. As shown therein, the components include a master handle 126 which would be fixedly mounted to shaft 128 which extends through the tank wall. Handle 126 and shaft 128 thus jointly rotate. Shaft 128 in turn extends through lifting member or lever 130 so that when handle 126 is rotated the lever 130 also rotates. In this embodiment, the lifting lever 130 includes structure to function as the air flow block. Lever 130 includes a nipple 50 onto which the air tube 44 which would be mounted to communicate the passageway 64 having a full flush branch 66 and a partial flush branch 68. Needle valves 80 and 82 or other suitable valves could adjust the flow through each of these branches. The partial flush branch outlet 70 is exposed at an inclined surface 132. A longitudinal hole 134 extends completely through lifting lever 130 through which shaft 128 would be located and locked for joint rotation with lifting lever 130.

The system shown in FIG. 9 also includes a flow control member 136 mounted against lifting lever 130. Member 136 has a lower flat extension or lifting tab 138 and an inclined wall or valve tab 140 which acts as a valve when it is disposed against outlet 70 for closing the outlet. Valve tab 140 includes a resilient pad or gasket 141 for creating a seal around outlet 70 by pressing against the area of surface 132 where outlet 70 is located. A further difference of the embodiment of FIGS. 9–14 in comparison to the embodiment of FIGS. 1–5 is that the air tube 44 also functions as the transmission member instead of having a separate transmission member such as chain 38. It is to be understood that the embodiment of FIGS. 1–5 may also utilize the air tube as the transmission member.

An auxiliary handle 144 is mounted outwardly of the master handle 126. Handle 144 is of generally L-shaped fitting in a generally L-shaped recessed wall 146 of master handle 126. The outer end 148 of auxiliary handle 144 extends outwardly away from master handle 126 as shown in FIG. 12, so that the auxiliary handle is readily accessible to be rotated during its actuation operation. Similarly, by having master handle 126 extend laterally outwardly of auxiliary handle 144, the master handle is readily accessible.

Auxiliary handle 144 is secured to shaft 150 which is of smaller diameter than shaft 128. Shaft 128 is hollow or of tubular form so that shaft 150 can extend through and rotate independently of outer shaft 128. Shaft 150 would ultimately be mounted in hole 152 of control member 136 so that rotation of auxiliary handle 144 causes inner shaft 150 to rotate and thereby also cause rotation of control member 136. In this manner, valve member 140 could be moved away from outlet 70 of partial flush branch 68.

Although full flush branch 66 is illustrated as being horizontal. The full flush branch could also be vertical and a power assist tube similar to tube 124 could be mounted at the outlet of the full flush branch 66.

Full flush operation would be initiated by pushing downward on master handle 126, thereby rotating outer shaft 128 and rotating lifting lever 130 which in turn raises the air line/transmission member 44 to raise the tank ball 16 off the flush valve seat. Adjustment of the full flush could be accomplished by rotating needle valve 80 toward or away from a valve seat within the branch 66 to increase or decrease the length of flush.

Partial flush operation is initiated by pushing down on auxiliary handle 144 rotating the inner shaft 150 and subsequently rotating the control member 136 to move valve 140 away from the valve seat or outlet 70 thereby allowing exhaust of air from the tank ball 16 through the passageway 64 and branch 68 causing the tank ball 16 to become less buoyant and return to the flush valve seat 14 before total evacuation of flush water from the tank. If branch 66 is open, air also exhausts through branch 66. Simultaneously, as valve 140 rotates away from the outlet 70, the tab or extension 138 contacts the bottom of lever 130 lifting the lever 130 which in turn raises the tank ball 16 off the flush valve seat by means of the connecting air tube 44. Adjustment of partial flush needle valve 82 inwardly toward its valve seat in branch 68 increases the length of partial flush while adjustment away from the valve seat produces a shorter partial flush.

Outer shaft 128 could be locked to lever 130 in any suitable manner. For example, as illustrated, a fastener could be inserted through the hole 154 in the split end of lever 130 and extend into the lower portion of the split end after the shaft 128 is in hole 134 to clamp the shaft 128 to the lever 130. Similarly, shaft 150 could be locked to control member 136 by insertion of a fastener through hole 156 which would firmly press against shaft 150.

FIGS. 15–19 show still yet another embodiment of this invention wherein the dual handle effect is created by a single handle member. As shown therein, many of the same components are included in this system and thus the same reference numerals are used for those components. One of the differences is that the air flow block 158 has a longitudinal passageway 160 into which a piston 162 is slidably mounted. Piston 162 is coupled to the end of a shaft 164 by shaft 164 extending through an elongated slot 166 in the upper end of piston 162 and movable in a vertical plane. Air flow block 158 also includes an elongated slot 168 through which the lever 34 extends.

Piston 162 has a longitudinal axial air duct 170 which communicates with a transverse or lateral air duct 172. By moving piston 162 in or out, the transverse passageway 172 is selectively in communication with either the full flush branch 66, as illustrated in FIG. 17, or with the partial flush branch 68. The outer surface of piston 162 is provided with a plurality of spaced O-rings 174 to provide a sealing arrangement during the sliding movement of piston 162 in opening or passage 160 and to create sufficient friction to maintain piston 162 in whatever vertical location it is placed.

FIG. 17 also shows the incorporation of a power assist tube 124 at the bottom of block 158 in communication with the axial passageway 170 of piston 162.

Shaft 164 extends through a hole 165 in lifting lever 34 so that when lever 34 passes through the slots 168 in the walls 169 of block 158, the shaft 164 is passing through the lever and into the slot 166 of piston 162. Alternatively, the lifting lever could pass through a hole in the shaft to couple the lifting lever and shaft together.

Figure 19:
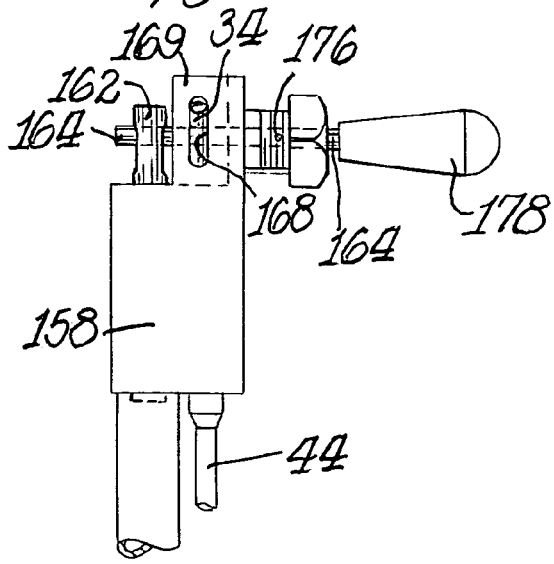

As shown for example, in FIGS. 17 and 19, a pivot pin 176 extends through block 158 and through shaft 164 so that the shaft 164 is pivotably mounted to block 158. A handle 178 which is illustrated as being of teardrop shape, is mounted to shaft 164.

Figure 15:
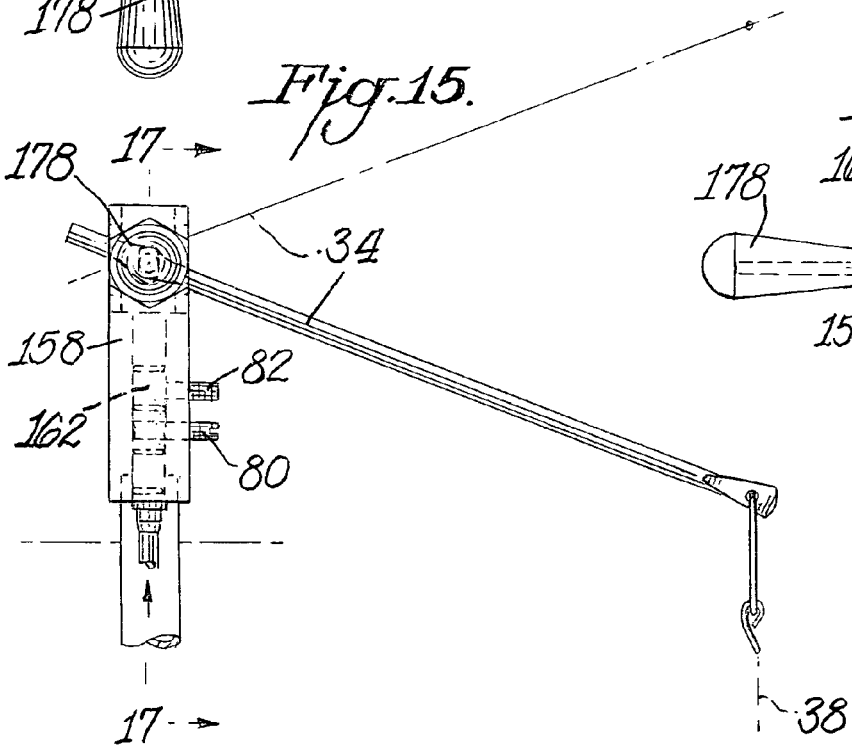
FIG. 15 is a front elevational view of still yet another system in accordance with this invention.

FIG. 15 shows in solid lines the position of lifting lever 34 when the tank ball is engaged with the seat before there is any flushing. In that condition, piston 162 may have its lateral duct 172 out of registry with either of the branches 66 or 68 or preferably may be in registry with either branch. In operation, handle 178 would be pushed downwardly and would rotate shaft 164 about pivot pin 176 in a clockwise direction as shown in FIG. 19. The rotation of handle 178 would cause the end of shaft 164 in the piston 162 to move upwardly in slot 166 of piston 162. Because shaft 164 extends through a tight opening in lever 34, lever 34 is caused to move in a counterclockwise direction in a vertical plane, as shown in phantom in FIG. 15. FIG. 17 illustrates lateral duct 172 in flow communication with full flush branch 66. Downward movement of handle 178 from its parked position causes the shaft 164 to raise piston 162 as shown by the arrow of FIG. 17. As a result, lateral duct 172 in piston 162 communicates with partial flush branch 68 whereby the air flowing through tube 44 can enter passageway 64 and exit from block 158 through branch 68 into the longitudinal duct 170 of piston 168 and then into the pressure assist tube 124. This causes a fairly quick removal of the air from the tank ball to result in a short or partial flush.

If a full flush is desired, handle 178 is moved upwardly from its normal parked position causing shaft 164 to lower piston 162 until its lateral duct 172 communicates with full flush branch 66 so that the air from tube 44 can then exit from passageway 64 through branch 68 into piston duct 170. Full flush branch 68 would have lesser air flow capacity than partial flush branch 68. As a result, there is a longer flush since more time is required to evacuate the air from the tank ball.

The piston 162 has two positions. Its lowermost position is the full flush position where duct 172 communicates with full flush branch 66 position. Its uppermost position would be the partial flush position where duct 172 communicates with partial flush branch 68. In this position a solid portion of piston 162 is disposed at partial branch 68 acting as a valve to close branch 68. Since full flush branch 66 has lesser flow capacity than partial flush branch 68, the air is purged more quickly when piston 162 is in its partial flush position.

The embodiment of FIGS. 15–19 may be practiced in various manners where selective isolation of the partial flush branch and the full flush branch is achieved. Thus lateral duct 172 is selectively in communication with one of the branches and isolated from the other branch. This could be accomplished by raising handle 178 for partial flush and lowering handle 178 for full flush or alternatively by lowering handle 178 for partial flush and raising handle 178 for full flush. Flow adjusting structure such as needle valves 80,82 could be used in branches 66,68 as fine adjustment members or screws to select the desired flush duration. The manipulation of valves 80,82 makes it possible select which of the branches will be the partial or the full flush branch. For example, the flow could be adjusted by valves 80,82 where there is lesser flow capacity in branch 68 thereby making that branch the "full flush" branch.

It is to be understood that the invention can be practiced where features disclosed in one embodiment can be incorporated in other embodiments. Thus, for example, any of the embodiments may use the air tube as the transmission member instead of a separate member (e.g. chain). Similarly any embodiment may use a power assist evacuation tube. Different structures for the handles, lifting levers, air flow blocks, etc. may also be used in various embodiments.

What is claimed is:

1. A two stage toilet tank bowl control system comprising a water tank, a valve seat in said water tank, a tank ball selectively positioned on said valve seat for controlling the flow of water from said tank, a flush actuating system mounted to a wall of said tank, said actuating system including a lifting member, a transmission member connecting said lifting member to said tank ball for moving said tank ball off said seat when said lifting member is moved in a flushing direction and for permitting said tank ball to return to being seated on said valve seat when said lifting member is moved in a return direction, said tank ball comprising a hollow housing having an open end disposed toward said valve seat, an air outlet tube mounted at one end to said hollow housing in flow communication with the interior of said hollow housing, said actuating system including an air flow block containing a flow passageway having an inlet end, said passageway having a full flush branch with an outlet end and having a partial flush branch with an outlet end, each of said outlet ends leading to the outer surface of said block, said air tube having a second end in flow communication with said inlet end of said passageway, a partial flush valve selectively opening and closing flow of air from outlet end of said partial flush branch, a handle assembly, said handle assembly including master handle structure for moving said lifting member in its flushing direction to move said tank ball off said valve seat and permit air to flow from said hollow housing through said passageway and through said full flush branch and out of said block while said partial flush valve closes said partial flush branch, and said handle assembly including auxiliary handle structure for moving said lifting member in its flushing direction to move said tank ball off said valve seat and to open said partial flush valve and permit air to flow from said hollow housing through said passageway and through said partial flush branch and out of said block with a lesser amount of water use than when said master handle structure is actuated.

2. The system of claim 1 wherein said air outlet tube also comprises said transmission member.

3. The system of claim 1 including a power assist tube in flow communication with said full flush branch and said partial flush branch for extending below the water level in said tank to create air suction at said full flush branch when water flows out of said power assist tube during the flushing operation.

4. The system of claim 1 including a flow control valve mounted at each of said full flush branch and said partial flush branch to control the amount of flow through each of said full flush branch and said partial flush branch.

5. The system of claim 1 wherein said lifting member is a pivoted lifting lever connected to said transmission member, and said handle assembly being connected to said lifting lever to cause said lifting lever to rotate in said flushing direction, and to rotate in said return direction.

6. The system of claim 5 wherein said master handle structure comprises a master handle in the form of a pivoted lever, and said auxiliary handle structure comprises a push button selectively movable toward and away from said wall of said tank.

7. The system of claim 6 wherein said actuating system includes a rotatable shaft extending through said air flow block, said master handle being coupled to said shaft to cause said shaft to rotate when said master handle is pivoted, said lifting lever being linked to said shaft whereby said lifting lever is rotated when said shaft is rotated, said auxiliary handle push button being mounted against said shaft to push said shaft longitudinally inwardly when said push button is pushed inwardly, a carrier mounted on said shaft, said partial flush valve being mounted on said carrier for movement away from said outlet of said partial flow branch when said shaft is moved inwardly, an actuator mounted to said air flow block and disposed against said shaft, and said lifting lever being coupled to said actuator to cause said lifting lever to pivot when said shaft pushes against said actuator.

8. The system of claim 7 including a lifting link mounted to said shaft and extending outwardly from said shaft for joint rotational movement with said shaft, and said lifting lever being coupled to said lifting link whereby said lifting lever is rotated when said lifting link and said shaft are rotated.

9. The system of claim 8 wherein said lifting lever is generally L-shaped having a main portion and having a bent end generally parallel to said shaft, said bent end being connected to an extension generally perpendicular to said shaft, said extension and said lifting link being generally coplanar, and said extension being coupled to said lifting link by a rigid connector pivotally mounted to both said extension and said lifting link.

10. The system of claim 8 wherein said carrier is a leaf spring pivoted at one end to said block, said leaf spring having a hole through which said shaft extends, said partial flush valve being mounted to said leaf spring at a position between said pivoted one end and said hole, and longitudinal movement of said shaft in response to the pushing of said push button causing said leaf spring to pivot at said pivoted one end to move said partial flush valve away from said outlet of said partial flush branch to permit the flow of air out of said outlet of said partial flush branch.

11. The system of claim 10 wherein said partial flush valve is a resilient plug having a tapered circular outer surface for selectively fitting in said outlet of said partial flush branch.

12. The system of claim 10 including a casing mounted to said wall of said tank, said casing having a peripheral side wall and an open face disposed remote from said tank wall, a slot extending through said peripheral side wall, said master handle extending through said slot and coupled to said shaft within said casing, said push button extending out of said open face of said casing and being telescopically mounted for movement into said casing in a direction generally perpendicular to said master handle, a stop pin on said shaft, and a spring mounted between said stop pin and said push button to urge said push button away from said pin in a non-flushing direction.

13. The system of claim 12 including a pusher member mounted to the end of said shaft remote from said push button, an abutment member mounted on said shaft, said carrier being located between said pusher member and said abutment member, and said abutment member being movable into contact with said lifting link to limit the outward movement of said shaft.

14. The system of claim 13 wherein said actuator has a wall disposed against and in contact with said pusher member, said actuator being pivotally mounted to said block, and said lifting lever extending through a hole in said actuator whereby said pusher member causes said actuator to rotate when said push button is pushed inwardly with the engagement of said lifting lever in said hole of said actuator causing said lifting lever to rotate in its flushing direction.

15. The system of claim 5 wherein said air flow block is mounted to and is part of said lifting lever, a control member mounted at said block, said control member having a valve tab which is disposed against said partial flush branch outlet, and said valve tab comprising said partial flush valve.

16. The system of claim 15 wherein said master handle structure is a master handle in the form of a master handle lever mounted on a shaft, said shaft extending through said lifting lever and being coupled to said lifting lever for rotating said lifting lever while said valve tab of said control member remains in closing contact with said partial flush branch outlet.

17. The system of claim 16 wherein said shaft comprises a hollow tubular outer shaft, said auxiliary handle structure being in the form of a pivoted auxiliary handle lever, an inner shaft telescopically mounted in said outer shaft and extending into engagement with said control member whereby rotation of said auxiliary handle lever causes said inner shaft and said control member to rotate, and rotation of said control member causes said valve tab to be removed from said partial flush branch outlet.

18. The system of claim 17 wherein said control member has a lifting tab disposed below said lifting lever, and rotation of said control member causes said lifting tab to rotate said lifting lever.

19. The system of claim 18 wherein said partial flush branch outlet is located on an inclined wall of said block, said valve tab of said control member being inclined and disposed at the same angle as said inclined wall to make surface contact with said inclined wall, and said valve tab having a resilient seal around said outlet of said partial flush branch.

20. The system of claim 5 wherein said air flow block has a longitudinal passage extending completely therethrough, a piston slidably mounted in said longitudinal passage, said piston having a longitudinal air duct which is open at one end, a lateral air duct in said piston communicating with said longitudinal duct, said lateral duct being in selective communication with said full flush branch and said partial flush branch in accordance with the positioning of said piston in said longitudinal passage, said handle assembly being mounted to one end of a shaft, the other end of said shaft being engaged with said piston whereby movement of said handle member is transmitted through said shaft for the selective raising and lowering of said piston, and said lifting lever being mounted to said shaft.

21. The system of claim 20 wherein said shaft is pivotally mounted in a vertical plane for raising and lowering said lifting lever and for raising and lowering said piston, and said handle assembly comprising a single handle which is both said master handle structure and said auxiliary handle structure in accordance with the degree of pivoting of said shaft.

22. The system of claim 21 wherein said shaft and said lifting lever are disposed generally perpendicularly to each other and are coupled together by one of said shaft and said lifting lever extending through a hole in the other of said shaft and said lifting lever.

23. The system of claim 22 including sets of spaced sealing members on the outer surface of said piston to create a seal at spaced locations with respect to said outer surface of said piston against the inner surface of said longitudinal passage in said block, said piston being movable to an upward partial flush position to dispose said lateral duct in flow communication with said partial flush branch, and said piston being movable to a downward full flush position when said piston is lowered from said partial flow position with said lateral duct being in flow communication with said full flush branch when said outlet of said partial flush branch is closed by a solid portion of said piston being located at said partial flush branch outlet whereby said closed portion of said piston comprises said partial flush valve.

24. The system of claim 23 wherein said shaft extends through a slot in said piston to raise and lower said piston upon the rotation of said shaft in a vertical plane, said lifting lever extending through a slot in said block to permit said lifting lever to move in a vertical plane, and said shaft being pivotally mounted to said block.

25. A toilet tank bowl flushing system comprising a water tank, a valve seat in said water tank, a tank ball selectively positioned on said valve seat for controlling the flow of water from said tank, a lifting lever in said water tank, a transmission member connecting one end of said lifting lever to said tank ball for moving said tank ball off said valve seat when said lifting lever is rotated in a flushing direction and for permitting said tank ball to return to being seated on said valve seat and said lifting lever is rotated in a return direction, a support block mounted to a wall of said water tank, a shaft slidably mounted through said support block, a push button mounted against said shaft whereby the inward pushing of said push button causes said shaft to move inwardly, an actuator pivotally mounted to said support block and disposed against an end of said shaft whereby inward movement of said shaft causes said actuator to rotate, and said lifting lever being mounted through a hole in said actuator whereby rotation of said actuator in response to the inward movement of said shaft causes said lifting lever to be raised in said flushing direction.

26. The system of claim 25 wherein said tank ball comprises a hollow housing having an open end disposed toward said valve seat, an air outlet tube mounted at one end to said hollow housing in flow communication with a passageway in said support block, said passageway having an outlet end exposed at a wall of said block, a branch passage communicating with said passageway, a piston slidably mounted in said branch passage for selectively opening and closing of said outlet, and said piston being pivotally mounted to said actuator whereby rotation of said actuator upon the inward pushing of said push button and of said shaft causes said piston to move from a closed position to an open position whereby air may flow from said air tube through said passageway and out of said outlet.

* * * * *